US007174597B2

(12) United States Patent
Bruggeman

(10) Patent No.: US 7,174,597 B2
(45) Date of Patent: Feb. 13, 2007

(54) PAINT ROLLER ASSEMBLY

(75) Inventor: Daniel J. Bruggeman, Minneapolis, MN (US)

(73) Assignee: Diversified Dynamics Corporation, Minneapolis, MN (US)

( * ) Notice: Subject to any disclaimer, the term of this patent is extended or adjusted under 35 U.S.C. 154(b) by 0 days.

(21) Appl. No.: 10/971,351

(22) Filed: Oct. 22, 2004

(65) Prior Publication Data

US 2006/0085936 A1 Apr. 27, 2006

(51) Int. Cl.
*B05C 17/02* (2006.01)

(52) U.S. Cl. ..... 15/230.11; 492/19

(58) Field of Classification Search ..... 15/230.11; 492/13, 19

See application file for complete search history.

(56) References Cited

U.S. PATENT DOCUMENTS 2,478,318 A 8/1949 Raub, Jr.
3,623,179 A * 11/1971 Roth ..... 15/104.1
5,167,055 A * 12/1992 Stoddart et al. ..... 492/13
5,594,971 A * 1/1997 Nelson ..... 15/230.11
5,613,264 A * 3/1997 Knowles ..... 15/230.11
5,997,205 A 12/1999 Koide
2001/0025394 A1 * 10/2001 Napolitan ..... 15/230.11
2004/0205921 A1 10/2004 Woodruff

FOREIGN PATENT DOCUMENTS

EP 0962259 A2 12/1999
GB 2 155 147 * 9/1985

* cited by examiner

*Primary Examiner*—Randall Chin
(74) *Attorney, Agent, or Firm*—Gerald E. Helget; Nelson R. Capes

(57) ABSTRACT

A paint roller assembly, including a handle having an axially extending portion for mounting a roller; one end of the axially extending portion having an engagement member; and an end piece engaging the engagement member to hold the roller in place on the axially extending portion. The end piece has a pivoting latch for alternately gripping and releasing the engagement member.

7 Claims, 3 Drawing Sheets

PAINT ROLLER ASSEMBLY

BACKGROUND OF THE INVENTION

The invention relates to a paint roller.

FIG. 1 shows the prior art. Conventional paint rollers consist of a cylindrical roller body 10, also referred to below as a roller or paint roll, with an inner cylindrical tubular body 12 which serves to receive a roller coating 14 made of plush, felt or foamed material or similar material. In the interior of the tubular body, a slotted, radially widening axially extending portion 15 is generally provided. In one embodiment, on one side in the tubular body, the axially extending portion is secured by a corresponding projection against axial displacement. On the other side, in the direction of the opening of the tubular body, an end piece 16 is engaged in order to prevent the sleeve falling out. The axially extending portion performs the function of fixing the roller body axially on the handle 18. The handle 18 as a rule consists of a bent metal wire and, on its lower end, a handgrip 20 made of plastic.

Conventional paint rollers suffer from a number of problems, one of which is that the end piece 16 usually is press fit into the tubular body 12 very tightly, by means of an engagement member 17 having a groove 17*a* to prevent the sleeve 10 from falling out as the roller is used. When it becomes time to remove the sleeve 10 for cleaning or replacement, it is generally necessary to grip the sleeve 10 with one hand while gripping the end piece 16 with the other hand and pulling and twisting. This causes the hands to become covered with paint and paint may also end up on the clothing.

There is a need for an improved paint roller assembly that addresses the above disadvantages.

SUMMARY OF THE INVENTION

In a paint roller assembly, having a handle, and an axially extending portion extending from the handle for mounting a roller, an engagement member and an end piece mating with the engagement member:

(a) an engagement member further comprising a substantially spherical bearing and a groove between the substantially spherical bearing and the axially extending portion; and (b) an end piece engaging the engagement member to hold the roller in place on the axially extending portion;

(c) wherein the end piece further comprises a pivoting latch for alternately gripping and releasing the engagement member.

A principal object and advantage of the present invention is that the end piece of the paint roller assembly can be removed very easily by simply pressing the latch, rather than tugging on a close fitting end piece.

Another principal object and assembly of the present invention is that it allows the user to change paint rollers without the need to tightly grip the wet roller, thus getting less paint on the user's hands and person.

DETAILED DESCRIPTION OF THE PREFERRED EMBODIMENT

Figures 1, 2:
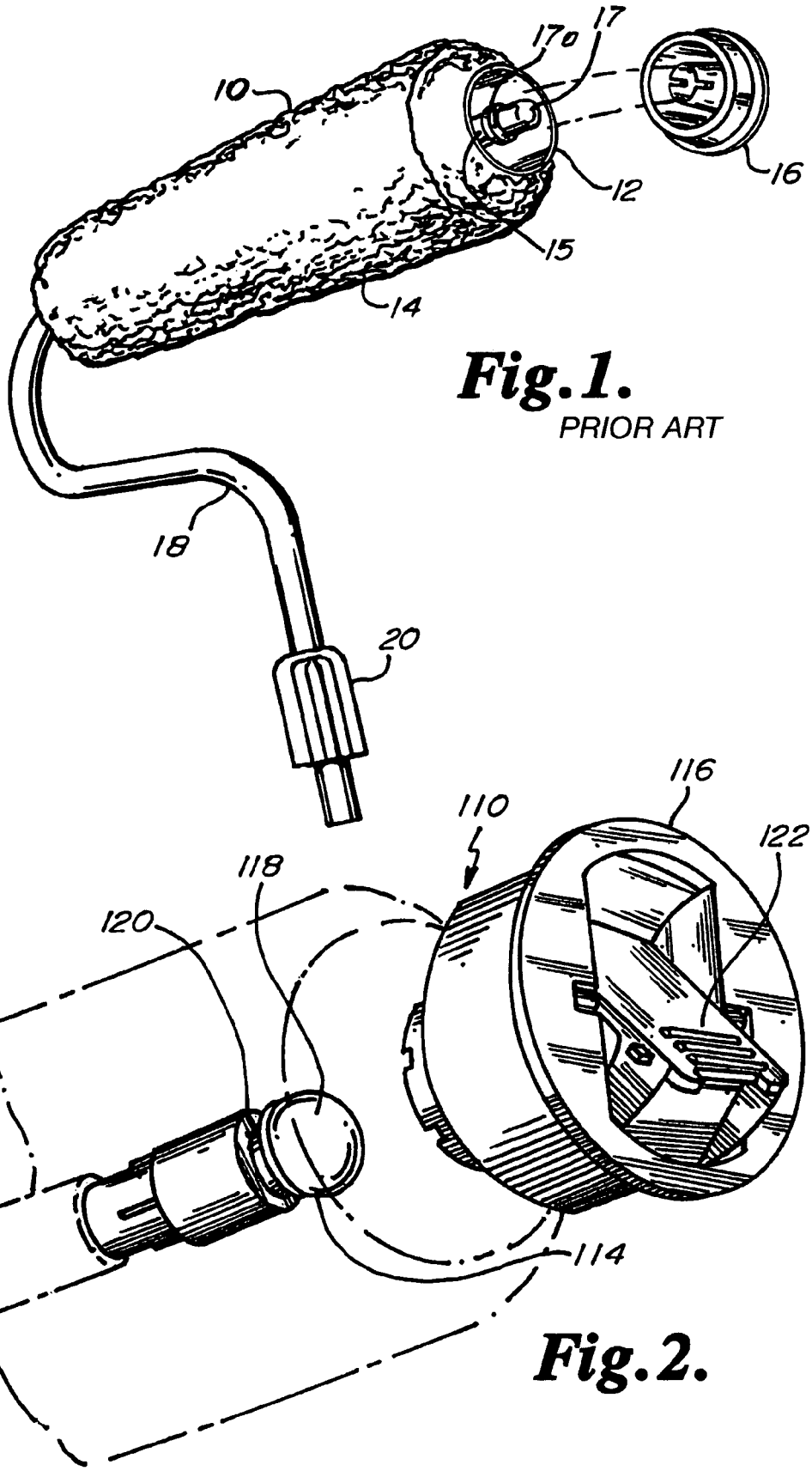
Fig. 1. PRIOR ART
FIG. 1 is a perspective view of a paint roller assembly of the prior art.
FIG. 2 is an exploded view of a portion of the paint roller assembly of the present invention. Items shown in phantom are not part of the invention.
Figure 3:
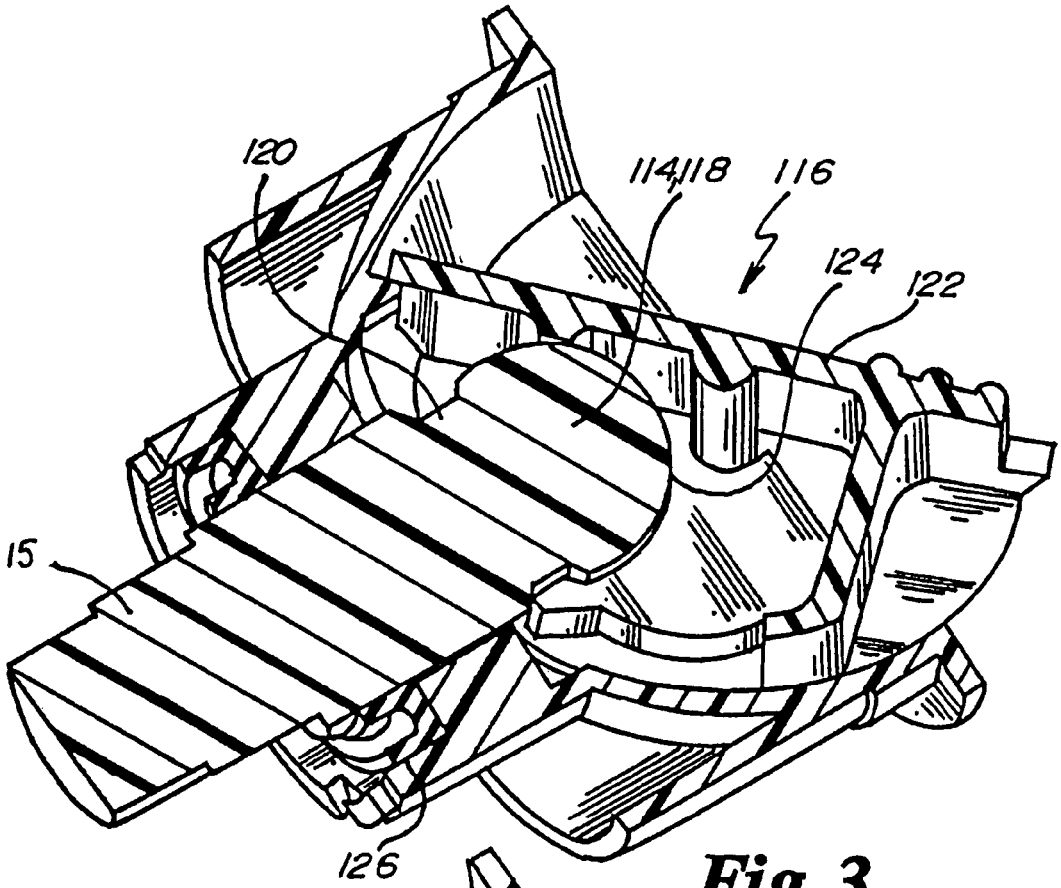
FIG. 3 is a cross section of a portion of the paint roller assembly of the present invention with the latching end piece not engaged.
Figure 4:
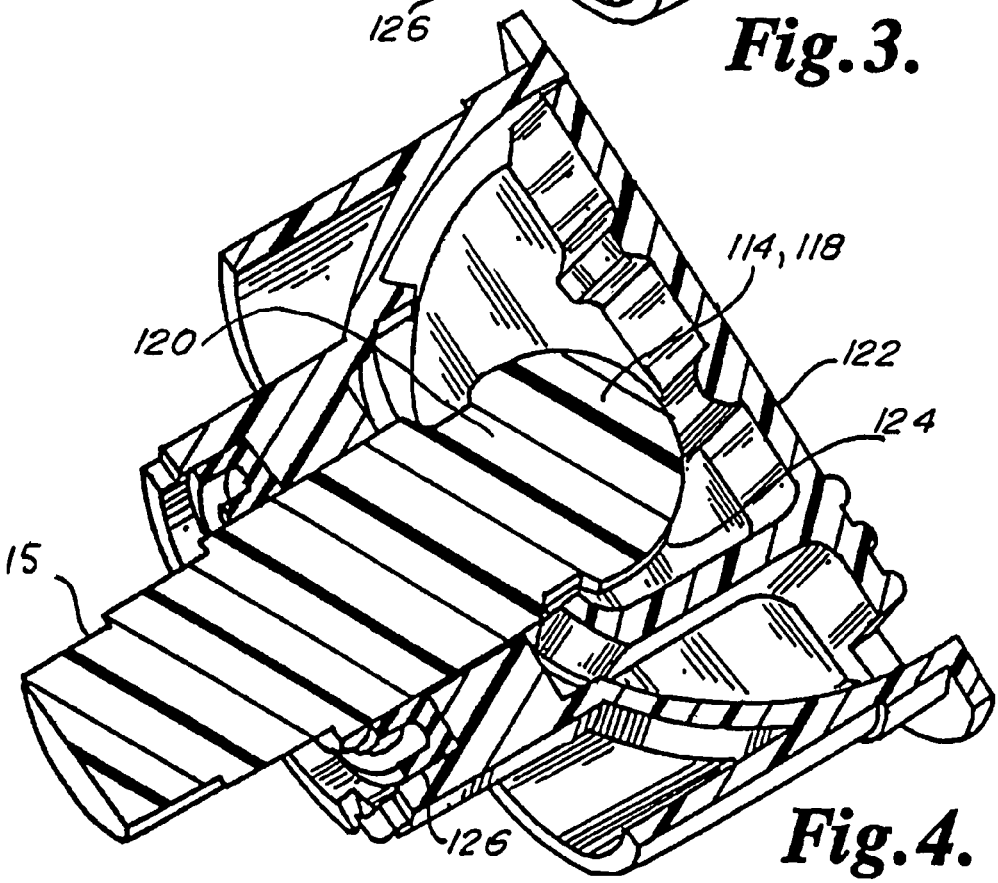
FIG. 4 is similar to FIG. 3, showing the latching end piece engaged.

The paint roller assembly of the present invention is generally shown in the Figures as reference numeral 110.

The paint roller assembly of the present invention 110 comprises a handle 18 (substantially the same as in the prior art). The handle has an axially extending portion 15 (again substantially the same as in the prior art).

Attached at one end of the axially extending portion 15 is an improved engagement member 114 that mates with an end piece 116 engaging the engagement member 114 to hold the roller in place on the axially extending portion 15. The engagement member 114 further comprises a substantially spherical bearing 118 and a grove 120 between the substantially spherical bearing 118 and the axially extending portion 15. The end piece 116 further comprises a pivoting latch 122 for alternately gripping and releasing the engagement member 114.

In the preferred embodiment, the pivoting latch 122 further comprises a cut-out 124 engaging the substantially spherical bearing 118 and the groove 120. The pivoting latch 122 pivots to alternately engage and disengage the cutout 124 from the spherical bearing 118 and the groove 120. Preferably, the end piece 116 further comprises a washer 126 engaging the axially extending portion 15.

Figure 5:
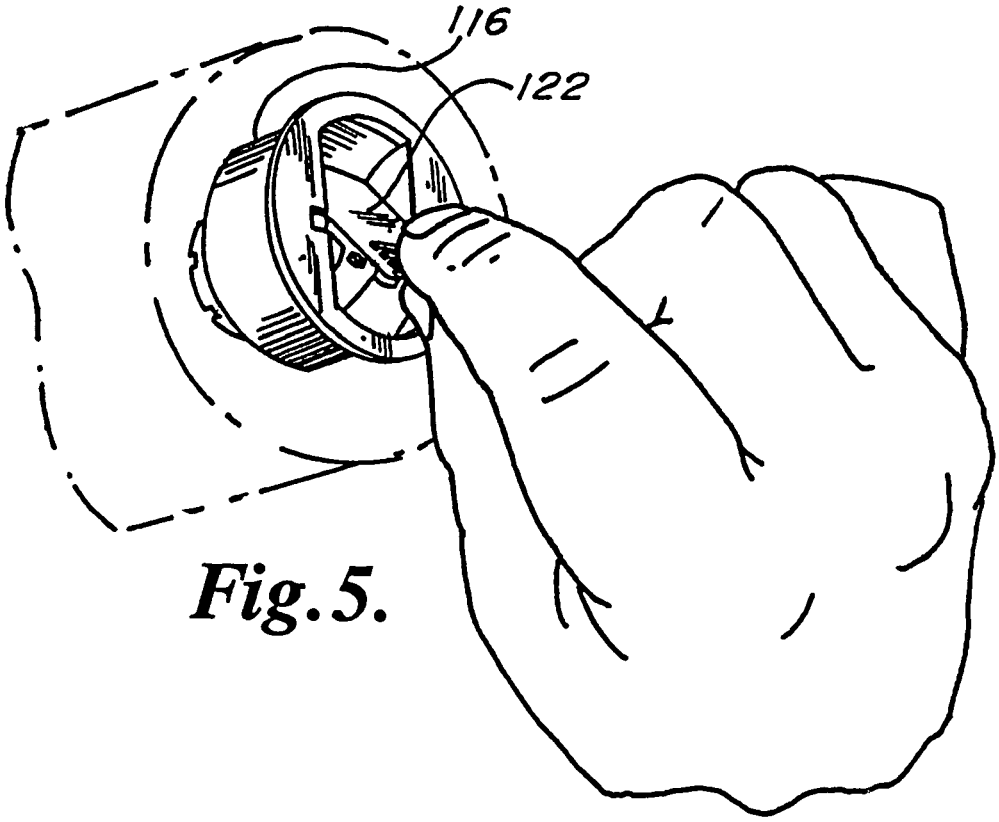
FIG. 5 is a perspective view of the present invention being used by a user.
Figure 6:
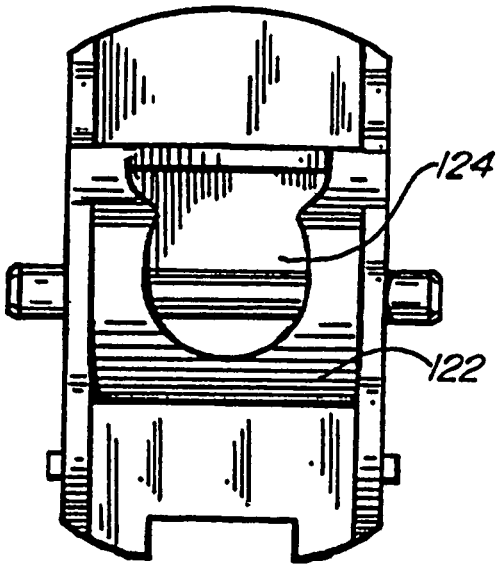
FIG. 6 is an interior view of the end piece of the present invention.
Figure 7:
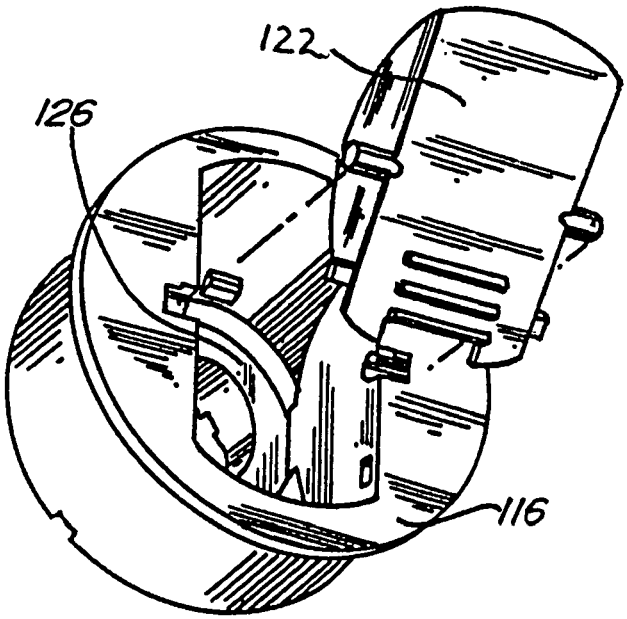
FIG. 7 is a perspective view of the end piece of the present invention.

To remove the roller body 10 from the axially extending portion 15, the user simply presses the pivoting latch 122 with a finger as shown in FIG. 5. This causes the latch to pivot, so that the cutout 124 releases the bearing 118 and the groove 120. The end piece 116 can then easily be removed with almost no pressure and the roller body can then also be removed.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described below. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a paint roller assembly, having a handle, an axially extending portion extending from the handle for mounting a roller, an engagement member and an end piece mating with the engagement member:

(a) the engagement member comprising a substantially spherical bearing and a groove between the substantially spherical bearing and the axially extending portion; and (b) the end piece engaging the engagement member to hold the roller in place on the axially extending portion; and (c) wherein the end piece further comprises a pivoting latch for alternately gripping and releasing the engagement member.

2. The paint roller assembly of claim 1, wherein the pivoting latch further comprises a cut-out engaging the spherical bearing and the groove.

3. The paint roller assembly of claim 2, wherein the pivoting latch pivots to alternately engage and disengage the cut-out from the spherical bearing and the groove.

4. The paint roller assembly of claim 3, wherein the end piece further comprises a washer engaging the axially extending portion.

5. In a paint roller assembly, having a handle, an axially extending portion extending from the handle for mounting a roller, an engagement member and an end piece mating with the engagement member:

(a) the engagement member comprising a substantially spherical bearing and a groove between the substantially spherical bearing and the axially extending portion; and (b) the end piece engaging the engagement member to hold the roller in place on the axially extending portion;

(c) wherein the end piece further comprises a pivoting latch for alternately gripping and releasing the engagement member, and (d) wherein the pivoting latch further comprises a cut-out engaging the spherical bearing and the groove.

6. The paint roller assembly of claim 5, wherein the end piece further comprises a washer engaging the axially extending portion.

7. In a paint roller assembly, having a handle, an axially extending portion extending from the handle for mounting a roller, an engagement member and an end piece mating with the engagement member:

(a) the engagement member comprising a substantially spherical bearing and a groove between the substantially spherical bearing and the axially extending portion; and (b) the end piece engaging the engagement member to hold the roller in place on the axially extending portion;

(c) wherein the end piece further comprises a pivoting latch for alternately gripping and releasing the engagement member;

(d) wherein the pivoting latch further comprises a cut-out engaging the spherical bearing and the groove;

(e) wherein the pivoting latch pivots to alternately engage and disengage the cut-out from the spherical bearing and the groove; and (f) wherein the end piece further comprises a washer engaging the axially extending portion.

* * * * *